US007759569B2

(12) United States Patent
Poels

(10) Patent No.: US 7,759,569 B2
(45) Date of Patent: Jul. 20, 2010

(54) CRASH 'N FLASH LIGHTING SYSTEM

(76) Inventor: Robert John Poels, 3815 Red Oak Dr., Green Bay, WI (US) 54313

( * ) Notice: Subject to any disclaimer, the term of this patent is extended or adjusted under 35 U.S.C. 154(b) by 0 days.

(21) Appl. No.: 12/459,818

(22) Filed: Jul. 8, 2009

(65) Prior Publication Data

US 2010/0005950 A1 Jan. 14, 2010

(51) Int. Cl.
*G10D 13/02* (2006.01)

(52) U.S. Cl. ..... 84/422.1; 84/453; 84/421

(58) Field of Classification Search ..... 84/421, 84/422.1, 422.2, 422.3, 453
See application file for complete search history.

(56) References Cited

U.S. PATENT DOCUMENTS 4,346,637 A * 8/1982 Janszen ..... 84/418
4,987,817 A * 1/1991 Diaz ..... 84/421

* cited by examiner

*Primary Examiner*—Kimberly R Lockett
(74) *Attorney, Agent, or Firm*—Steven H. Greenfield; Greenfield Invention and Patent Consulting, Inc.

(57) ABSTRACT

A lighting system that is controlled and operated by the cymbal player of a musical band is disclosed. A limiting switch actuator arm is mounted in a predetermined proximity to the underside of the cymbals such that striking the cymbal moves the actuator arm a sufficient distance to momentarily close an electrical circuit to which a light is connected and produce the flash-lighting effect. The actuator arm is encased in a plastic sleeve and has a sleeve tip and a bead attached at the cymbal contact end. The plastic sleeve, sleeve tip and bead protect against the risk of an electric shock, help protect the actuating arm against mechanical damage and help dissipate vibrations.

7 Claims, 3 Drawing Sheets

FIG. 4
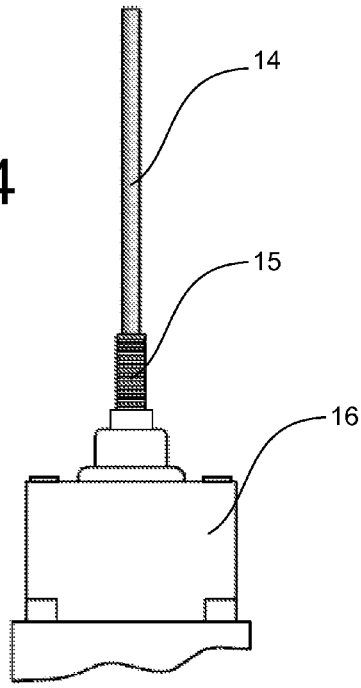
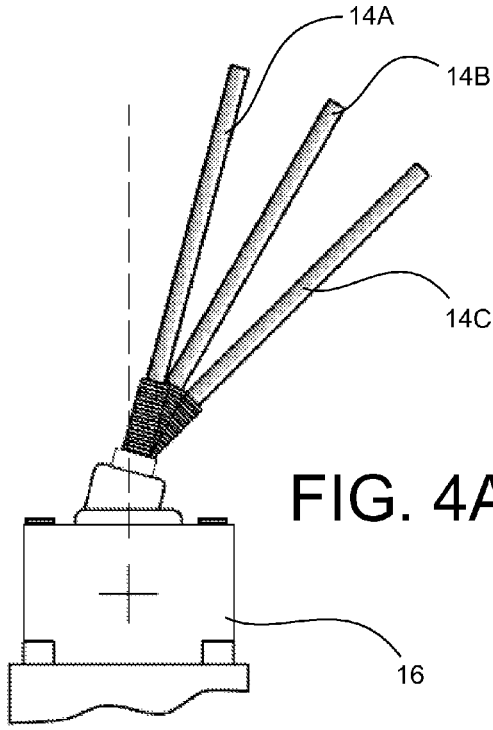
FIG. 4A

CRASH 'N FLASH LIGHTING SYSTEM

FIELD OF INVENTION

This invention relates to a device for creating a lighting effect while playing cymbals. More specifically, the present invention relates to a device for creating a flash-lighting effect by a cymbal player in a controlled fashion while playing the cymbals.

BACKGROUND OF THE INVENTION

Proficient use of current lighting systems in the entertainment industry require other performers to physically step on a series of switches on a pedal board, pre-program complicated DMX controllers, or use random scene controllers to change lighting scenes. While these systems are effective, they require attention from the musicians and certain programming skills. The lighting system of the present invention requires no special attention or programming skills as it is clearly operated by a cymbal player and cycled on or off through physical cymbal crashes. The presently invented lighting system would be easy to manufacture, use, store, and maintain, allowing lighting changes not possible with currently available systems and providing an "on cue" and functional alternative to random and predictable pattern sequenced light shows.

SUMMARY OF THE PRESENT INVENTION

It is the object of the present invention to provide a device that enables a cymbal player to create a flash-lighting effect by striking a predetermined spot on the strike side of the cymbal. The strike produces a cymbal movement that results in displacing an actuator arm positioned on the underside of that location. Displacing the actuator arm momentarily closes an electrical circuit that turns on a light connected to the electrical circuit. The actuator arm is configured to return to its original position when the actuating force is removed which results in the opening of the electrical circuit and the light to go off. The momentary light flashing effect that is created may be repeated at the discretion of the cymbal player by striking the same spot again and again.

BRIEF DESCRIPTION OF THE DRAWINGS

FIG. 4 shows the operation of a component of the device according to an embodiment of the present invention.

DETAILED DESCRIPTION OF THE PREFERRED EMBODIMENT

The device of the present invention makes use of a cat whisker type limiting switch. Cat whisker and wobble stick actuators each contains a long narrow rod on the top of a limit switch head which operates the switch contacts when deflected from the vertical position. Wobble sticks are typically nylon rods, while cat whiskers are made of flexible wire. Both are capable of operating in any direction, in a movement similar to a joystick, and return to their original position when the actuating force is removed. The contacts of a limit switch change state when a predetermined force or torque is applied to the actuator. A momentary spring return switch returns its contacts to their original position when the operating force is removed. Movement of the actuator applies force to an over-center mechanism, which creates a fast change in contact state when the trip point is reached. Reversing the motion of the actuator to a given reset point causes the contacts to snap back to their original position.

Figure 1:
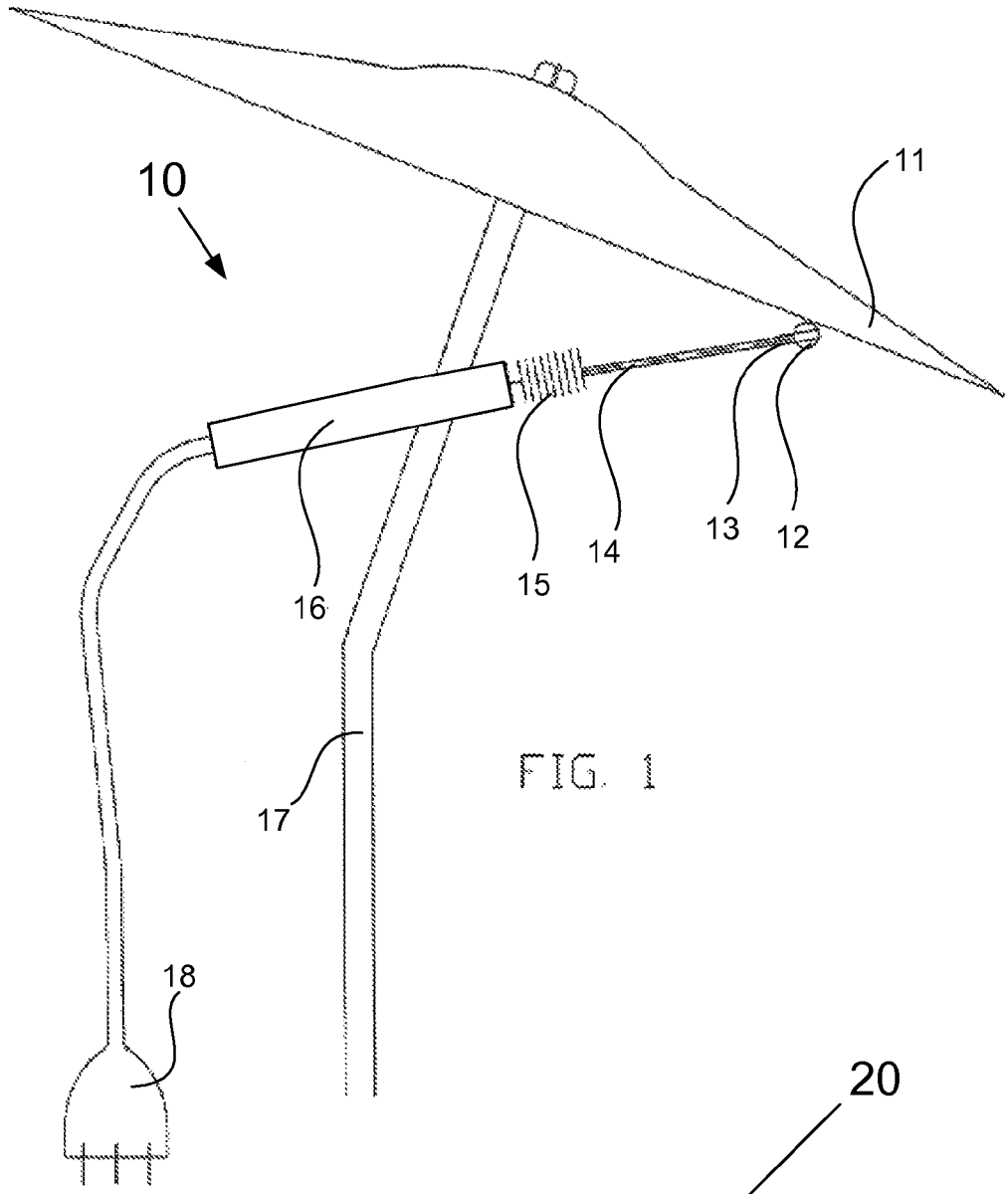
FIG. 1 is a front view representation of the light flashing device for a cymbal according to an embodiment of the present invention.
Figure 2:
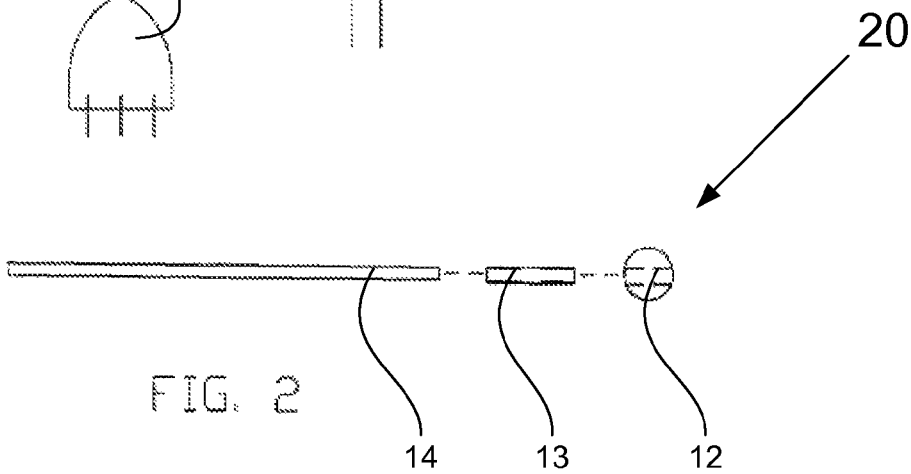
FIG. 2 is a front view representation of components for the light flashing device for a cymbal according to an embodiment of the present invention.
Figure 3:
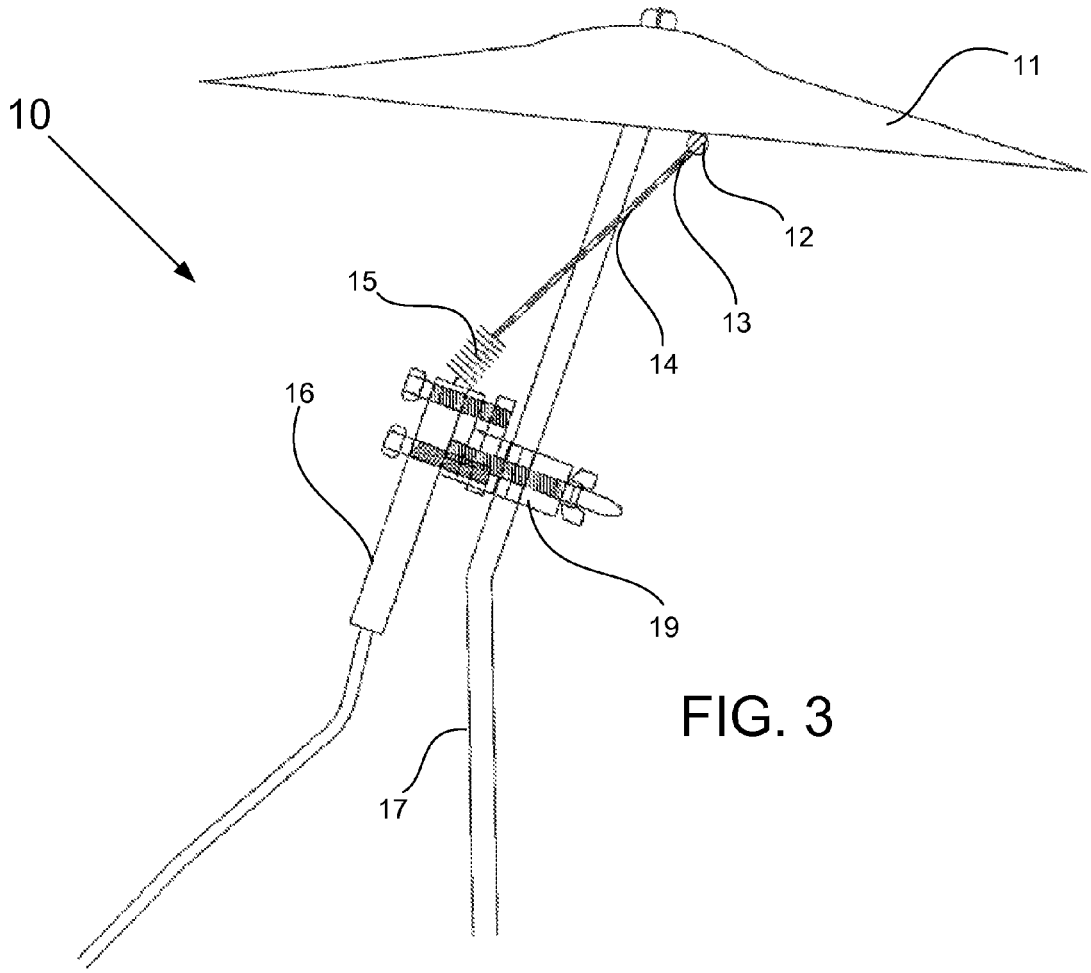
FIG. 3 is a front view representation of the light flashing device for a cymbal showing a connector for attaching the device to the cymbal stand according to an embodiment of the present invention.

The device for creating a lighting effect by a cymbal player is shown in FIGS. 1-4. Shown in FIGS. 1 and 2 are a box that contains the limit switch 16, actuator arm 14 shown encased in a sleeve, sleeve tip 13, coil member 15, bead 12, and electrical connector 18 that is typically a three prong type that plugs into a 110V outlet. The bead 12 attached to the cymbal contact end of the actuator arm 14 is positioned in close proximity with the underside of the cymbal 11 shown supported by a stand 17. FIG. 3 shows a locking collar 19 for mounting the device 10 onto the cymbal stand 17. FIG. 4 illustrates a wobble stick or a cat whisker type limiting switch 20 in an un-actuated position showing actuating arm 14, spring member 15 and limiting switch box 16. FIG. 4A illustrates the operation of the limiting switch. The actuator arm 14 has three deflection positions: 14B indicates an exemplary circuit trip point, which in this case is set to close the circuit and turn on the light, 14C shows an exemplary maximum deflection of the actuator art, and 14 A illustrates an exemplary reset point at which the light would turn off as the actuator arm resets to its original position. The actuator arm sleeve, the sleeve tip and the bead provide protection against damage to the actuator arm as well as protection against potential electrical shock. The sleeve tip and the bead also serve to absorb and dissipate any vibrations that could make the operation of the device irregular. The actuator arm sleeve, sleeve tip and bead may be made from a variety of plastics or a combination of plastic and cloth. The actuating arm is wound into a coil at the actuating end which provides needed rigidity for the actuating force to actuate the arm rather than simply bend it. The coil is unwound to a straight rod just before entering into the limiting switch box.

When the cymbal player strikes a location on the strike side of the cymbal above the bead 12 attached to the actuator arm, the strike produces a cymbal movement that results in displacing the actuator arm 14 positioned on the underside of that location. The cymbal 11 positioning on the stand 17 is flexible, thus a strike on any spot on the cymbal 11 results only in a momentary movement from which the cymbal 11 rebounds quickly. Displacing the actuator arm 14 momentarily closes an electrical circuit that turns on a light connected to the electrical circuit. The actuator arm returns to its original position when the cymbal bounces back which results in opening the electrical circuit and the light going off. Repeated strikes on the same spot on the cymbal thus creates the effect of the light going on to coincide with the strike on the cymbal and off shortly thereafter, thereby creating a coordinated sound and flash-lighting effect.

What is claimed is:

1. A device for creating a lighting effect from a cymbal, said cymbal having a striking side and an underside comprising:

a limiting switch containing an actuator arm, said actuator arm having a cymbal contact end and an actuating end;

an actuator arm sleeve that encases the actuator arm;

a sleeve tip attached to the actuator arm sleeve at the cymbal contact end of the actuating arm;

a bead attached to the cymbal contact end of the actuating arm, said bead being disposed in a proximity to a predetermined spot on the underside of the cymbal;

a coil member disposed at the actuating end of the actuating arm;

an electric circuit for turning a light on and off, said electric circuit being connected to the limiting switch and activated by the limiting switch; and a light connected to said electric circuit.

2. The device of claim 1, wherein the actuator arm comprises metal.

3. The device of claim 2, wherein the limiting switch comprises a cat whisker actuator.

4. The device of claim 1, further comprising a locking collar for attaching the device to a cymbal stand.

5. The device of claim 1, wherein the actuator arm sleeve comprises plastic.

6. The device of claim 1, wherein the sleeve tip attached to the actuator arm sleeve comprises vinyl plastic.

7. The device of claim 1, wherein the bead comprises plastic.

* * * * *